US008479543B2

(12) United States Patent
Yang et al.

(10) Patent No.: US 8,479,543 B2
(45) Date of Patent: Jul. 9, 2013

(54) DOOR LOCKING SYSTEM WITH AN IDLE HANDLE

(76) Inventors: Zaifu Yang, Ningbo (CN); Zhongwei Cao, Ningbo (CN)

( * ) Notice: Subject to any disclaimer, the term of this patent is extended or adjusted under 35 U.S.C. 154(b) by 0 days.

(21) Appl. No.: 13/148,106

(22) PCT Filed: Jun. 4, 2010

(86) PCT No.: PCT/CN2010/000795

§ 371 (c)(1),
(2), (4) Date: Aug. 5, 2011

(87) PCT Pub. No.: WO2011/066709

PCT Pub. Date: Jun. 9, 2011

(65) Prior Publication Data

US 2012/0291503 A1 Nov. 22, 2012

(30) Foreign Application Priority Data

Dec. 1, 2009 (CN) ..... 2009 1 0155113

(51) Int. Cl.
*E05G 1/04* (2006.01)
*E05B 63/14* (2006.01)
*E05B 47/00* (2006.01)

(52) U.S. Cl.
USPC ..... 70/118; 70/208; 70/284; 70/278.7; 70/279.1; 109/59 R; 292/36

(58) Field of Classification Search
USPC ..... 70/1.5, 91, 101–104, 108, 113, 118–120, 70/208, 275, 277, 278.1, 278.2, 278.4, 278.6, 70/284; 109/59 R, 59 T; 292/34, 36, 40, 157
See application file for complete search history.

(56) References Cited

U.S. PATENT DOCUMENTS

| | | | | |
|---|---|---|---|---|
| 4,470,277 | A * | 9/1984 | Uyeda | 70/118 |
| 4,669,394 | A * | 6/1987 | Fogleman et al. | 109/59 T |
| 5,111,674 | A * | 5/1992 | Huang | 70/118 |
| 5,231,935 | A * | 8/1993 | Oder et al. | 70/1.5 |
| 5,341,752 | A * | 8/1994 | Hambleton | 109/59 R |
| 5,603,234 | A * | 2/1997 | Lozier et al. | 70/119 |
| 6,679,087 | B2 * | 1/2004 | Suggs et al. | 109/59 R |
| 7,464,570 | B1 * | 12/2008 | Chen | 70/278.7 |
| 7,665,405 | B2 * | 2/2010 | Evans et al. | 109/59 R |

* cited by examiner

*Primary Examiner* — Christopher Boswell

(57) ABSTRACT

A door locking system with an idle handle has a door panel having a front face, a rear face, a hinged side, a free side, an upper side, a lower side, and an electronic lock and a mechanical lock installed in the door panel respectively having a keypad and a keyhole on the front face. The system further has a level toggler, at least one bolt, a chamber defined therein, a handle seat, a handle lever, a latch lever, a linking arm, a swivel pillar, a paddle shifter, an upright toggler, and an handle lever resume spring.

6 Claims, 14 Drawing Sheets

DOOR LOCKING SYSTEM WITH AN IDLE HANDLE

CROSS-REFERENCE TO RELATED APPLICATIONS

Not applicable.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The invention relates to a door locking system with an idle handle for use with, e.g., a safe.

2. Description of Related Art

Conventional safes usually have a handle consisting of a handle lever revolving round a handle pin securely fixed on a door of the safe. The handle lever is linked to a locking mechanism provided on an inner surface of the door. The locking mechanism has a toggle plate levelly movable with respect to the door, at least one bolt connected to the toggle plate, and a latch controlling the levelly movement of the toggle plate. A door frame having bolt receiving holes or bolt blocking bars is provided on the safe surrounding the door. When locked, the bolts enter the corresponding bolt receiving holes and the toggle plate is locked by the locking mechanism. The door will not be able to be opened without a key. The locking mechanisms may be either mechanical or electrical. In opening, when the locking mechanism is unlocked, the toggle plate may be able to levelly move. At this time, the door is able to be opened when the user pulls the handle lever outward. For this kind of conventional safe, if the locking mechanism or the toggle plate is destroyed, the door will be able to be opened by pulling the handle lever. Furthermore, the door might be illegally opened by forcefully pulling the handle lever to destroy the locking mechanism.

To resolve above problem, a safe with recessed handle lever is provided. The handle lever of the safe is placed in a recess defined in a door of the safe and basically has a height the same as a top surface of the door. The handle lever will not be liable to be collided in conveyance or forcefully pulled without a legal key or knowing correct pass code.

A Chinese utility model patent ZL20072019731.4 "A Retractable Handle Lever For Use With A Safe" discloses such a handle. The handle has a handle lever and a central pin passing the handle lever and installation holes defined in a door, a support spring provided between the handle lever and the door, a notch defined in a middle of the central pin, an active plate engagable with the notch, the active plate being hanged behind the door by a pin passing a guiding hole, a driving member directly or indirectly controlling the active plate, and a limit provided on an rear portion of the central pin.

In operation of such handle, a user has to press the handle lever into the door first and then lock the door in association with the active plate additionally provided on the surface of the door. It is complicated and wastes time.

And though the aforementioned retractable handle is able to prevent illegal break of the lock mechanism by forcefully pull the handle lever thereof to a certain extent, there is still such kind of risk since the handle lever is nevertheless linked to the locking mechanism.

For such conventional retractable handle, the handle lever only retracts into the door when the door is closed and the locking mechanism is locked. When the door is opened, the handle lever has to extend out from the door. Therefore there still is the risk that the handle lever is collided when the door is open.

BRIEF SUMMARY OF THE INVENTION

The main object of the invention is to provide a door locking system with an idle handle which is able to idle and not drive a toggle plate when the door is closed and locked.

Another object of the invention is to provide a door locking system with an idle handle a handle lever thereof is able to submerge under an outer surface of a door panel thus preventing the handle from being collided.

To achieve above object, the invention provides door locking system with an idle handle having:

- a door panel having a front face, a rear face, a hinged side, a free side, an upper side, a lower side, and an electronic lock and a mechanical lock installed in the door panel respectively having a keypad and a keyhole on the front face,
- a level toggler being slidable with respect to the door panel between a hinged side limit and a free side limit and having an L-shaped guiding groove with an upright section and a level section,
- at least one bolt linked to and controlled by the level toggler,
- a chamber defined in the door panel,
- a handle seat being received and securely fixed in the chamber and having a recess in the front face,
- a handle lever being received in the recess and having a hinged end pivotally linked to the handle seat and a free end,
- a latch lever controlled by the mechanical lock and having a latch finger formed thereon,
- a linking arm having one end securely fixed to the hinged end and a free linking end,
- a swivel pillar having a rectangular cross section and a lower end securely fixed to the free linking end of the linking arm,
- a paddle shifter having a top side protrusion slidably received in the guiding groove and a bottom with a rectangular opening slidably covering on the swivel pillar,
- an upright toggler being slidable with respect to the door panel between an upper side limit and a lower side limit and having a bottom plate touching and being fixed to the bottom of the paddle shifter and having an arc-shaped pillar opening covering on the swivel pillar, a top opening receiving the latch finger, and a side arm, and,
- a handle lever resume spring fixed between the linking arm and the door panel pulling the handle lever to press on the recess.

According to another aspect of the invention, the door locking system with an idle handle may further has a redundant lock is provided on the rear face of the door panel. The redundant lock has a base formed on the rear face of the door panel, a redundant bolt fixed to the side arm and being slidable with respect to the base, a redundant spring provided between the base and the redundant bolt, and a redundant bolt receiving opening defined in the level toggler.

It could be seen from the invention, with the user friendly operable revolving cover, which is able to conceal or reveal the keypad of the combination padlock, the keypad will be able to be kept from dust, pollution, and/or collisions. The aesthetic feeling of the whole combination padlock has also been improved.

DETAILED DESCRIPTION OF THE INVENTION

Figure 1:
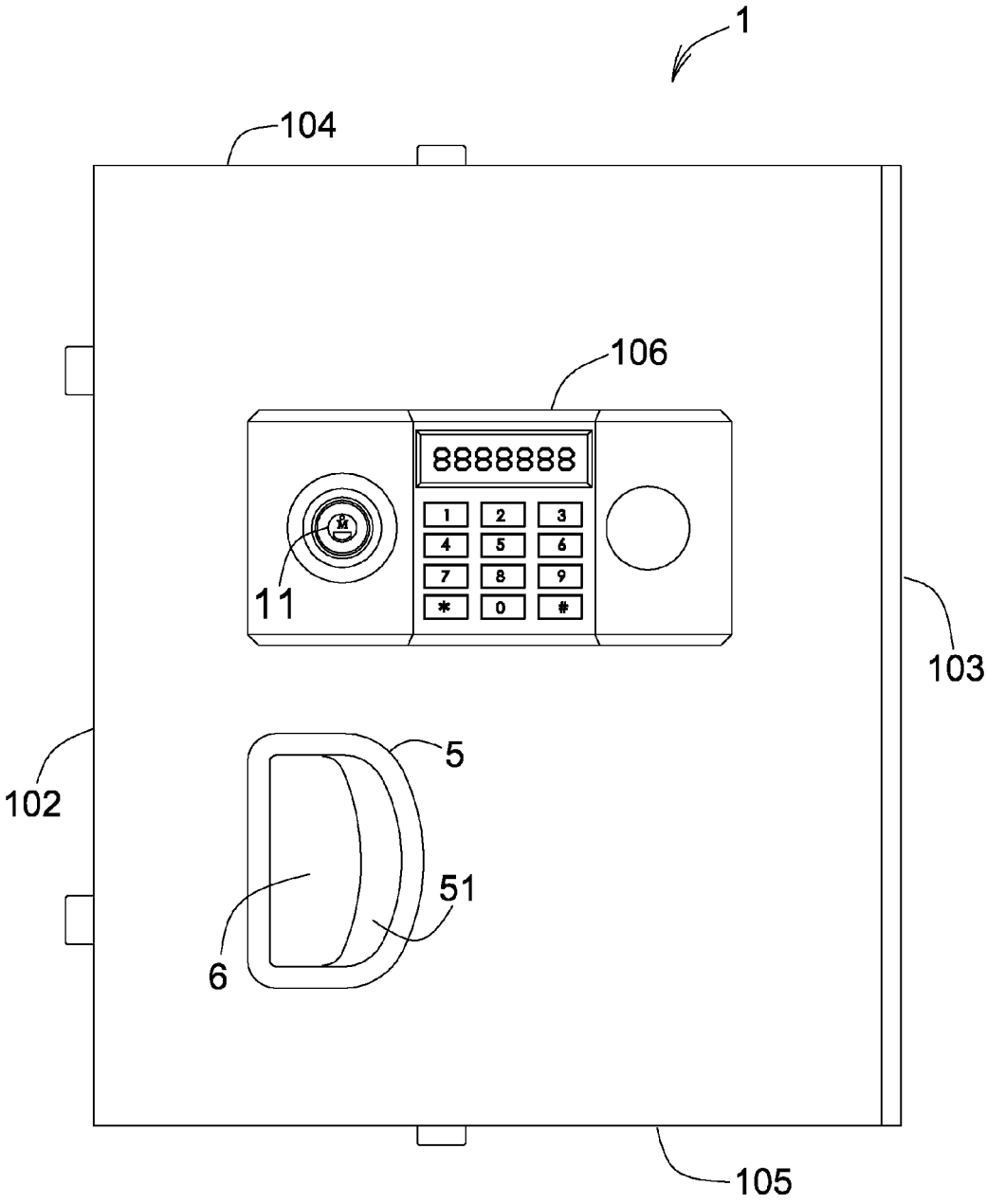
FIG. 1 is a front flat view of a door panel of the preferred embodiment of an idle handle for use with a safe of the invention.
Figure 2:
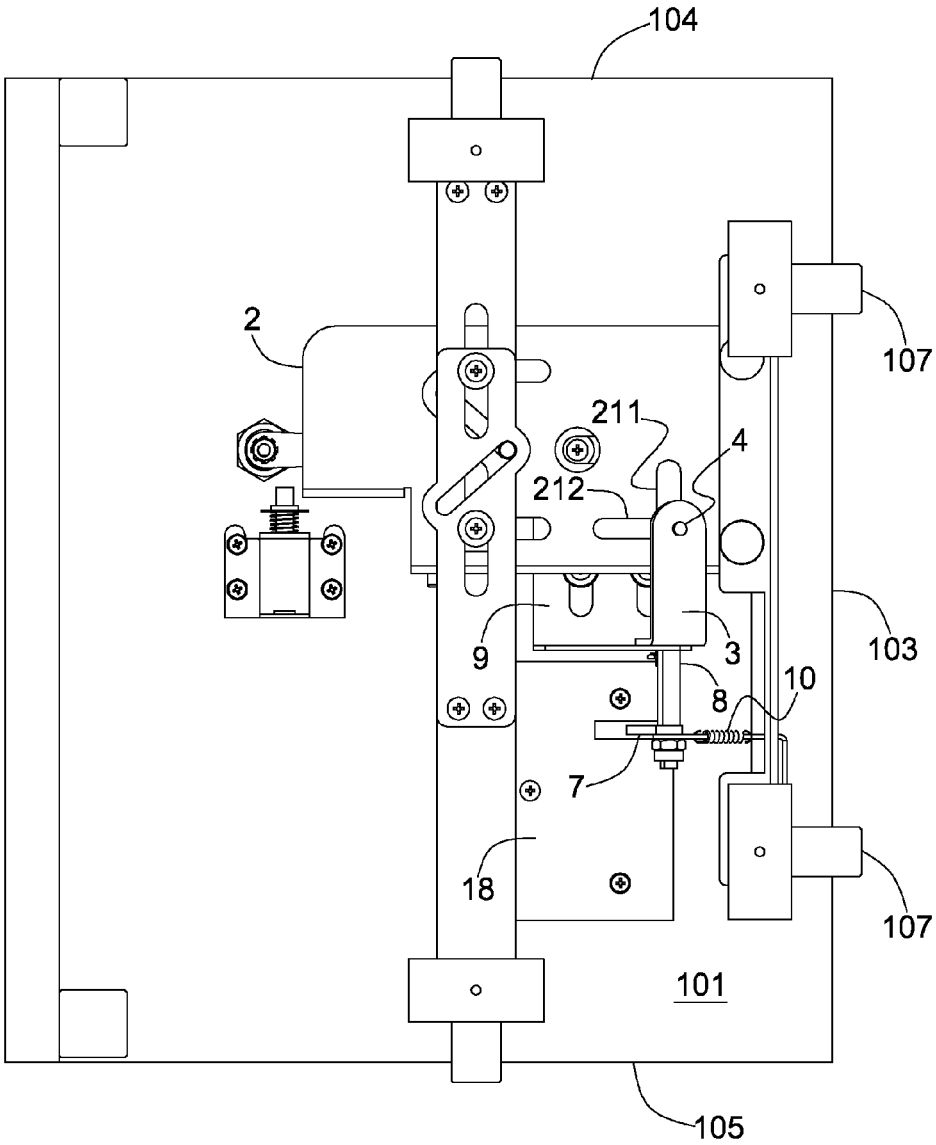
FIG. 2 is a rear flat view thereof.
Figure 3:
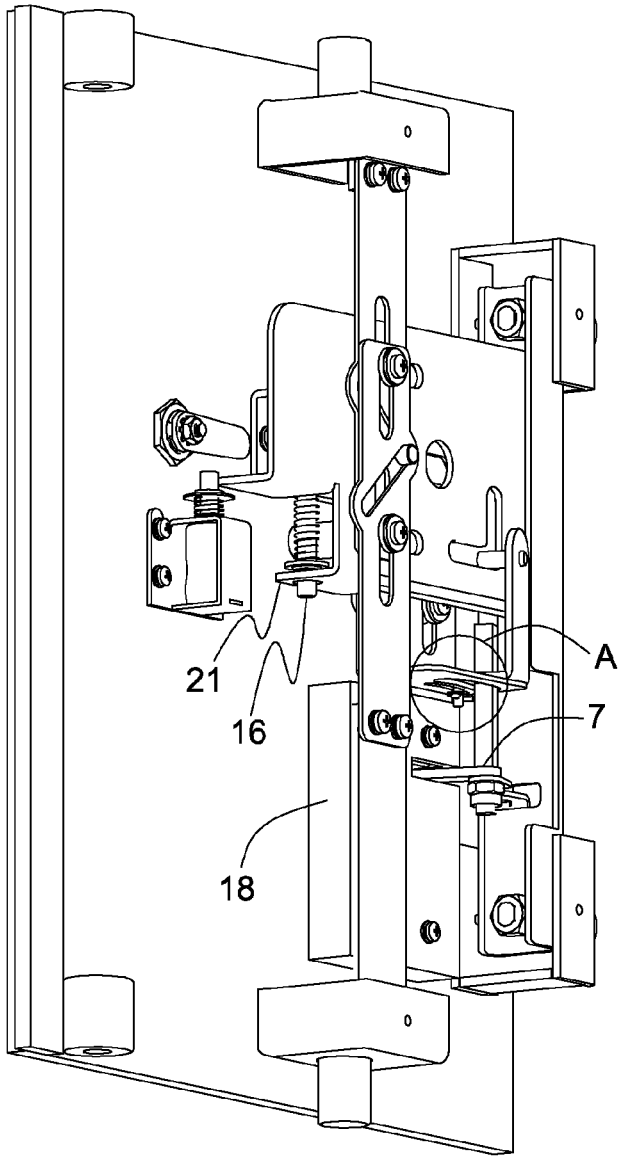
FIG. 3 is a perspective view thereof.
Figure 4:
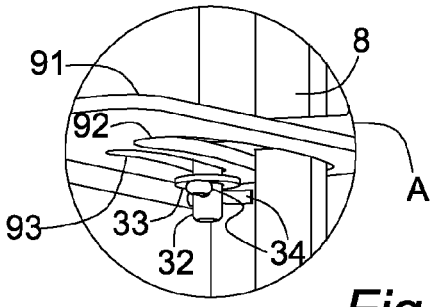
FIG. 4 is a partially enlarged perspective view of section A shown in FIG. 3.
Figure 5:
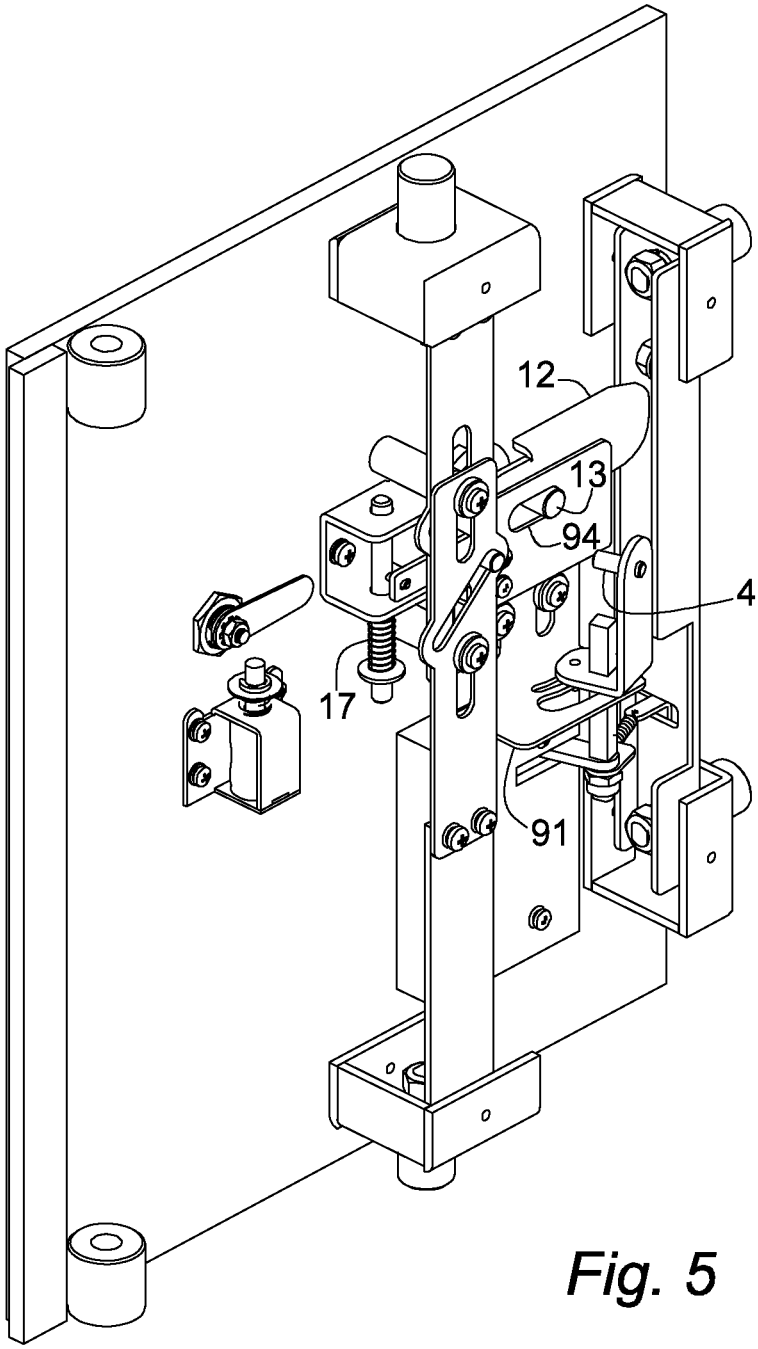
FIG. 5 is perspective view thereof without a toggle plate.
Figure 6:
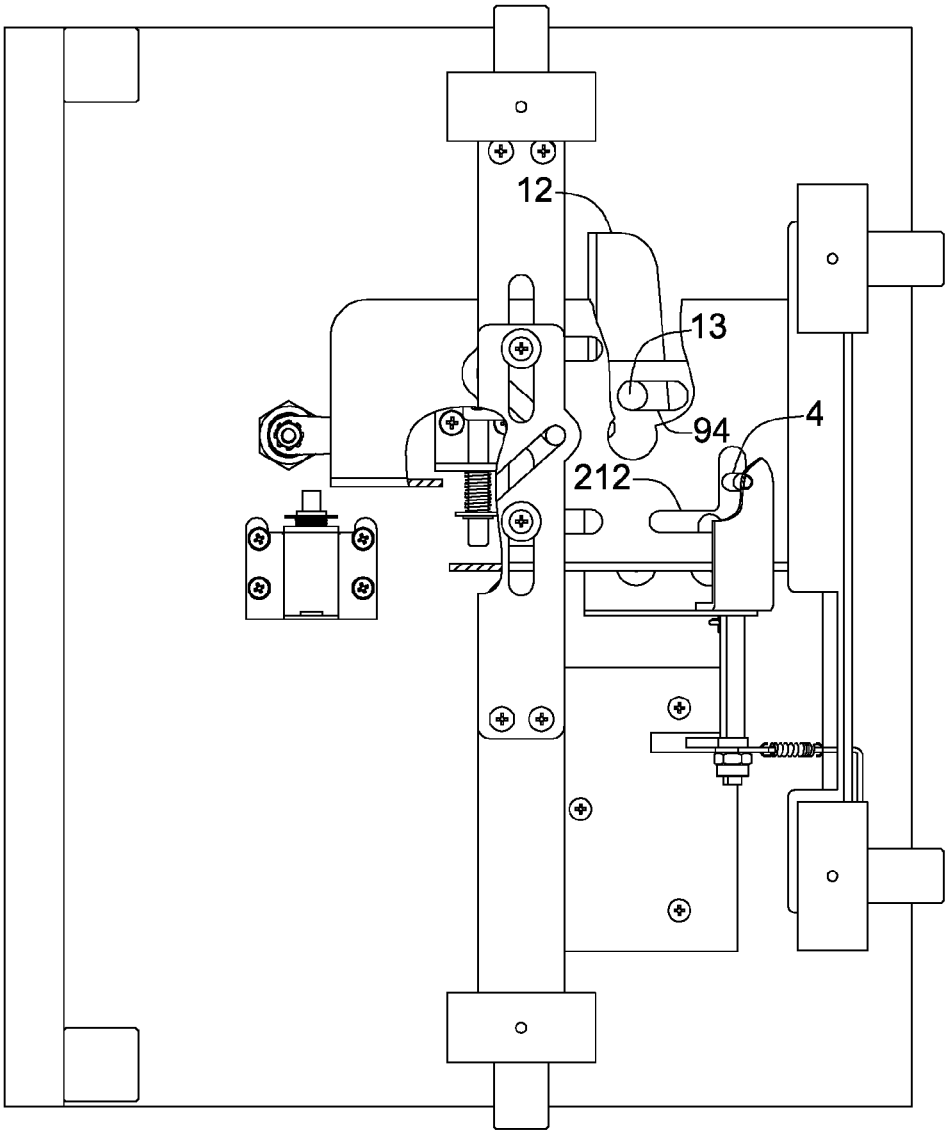
FIG. 6 is another rear flat view thereof.
Figure 7:
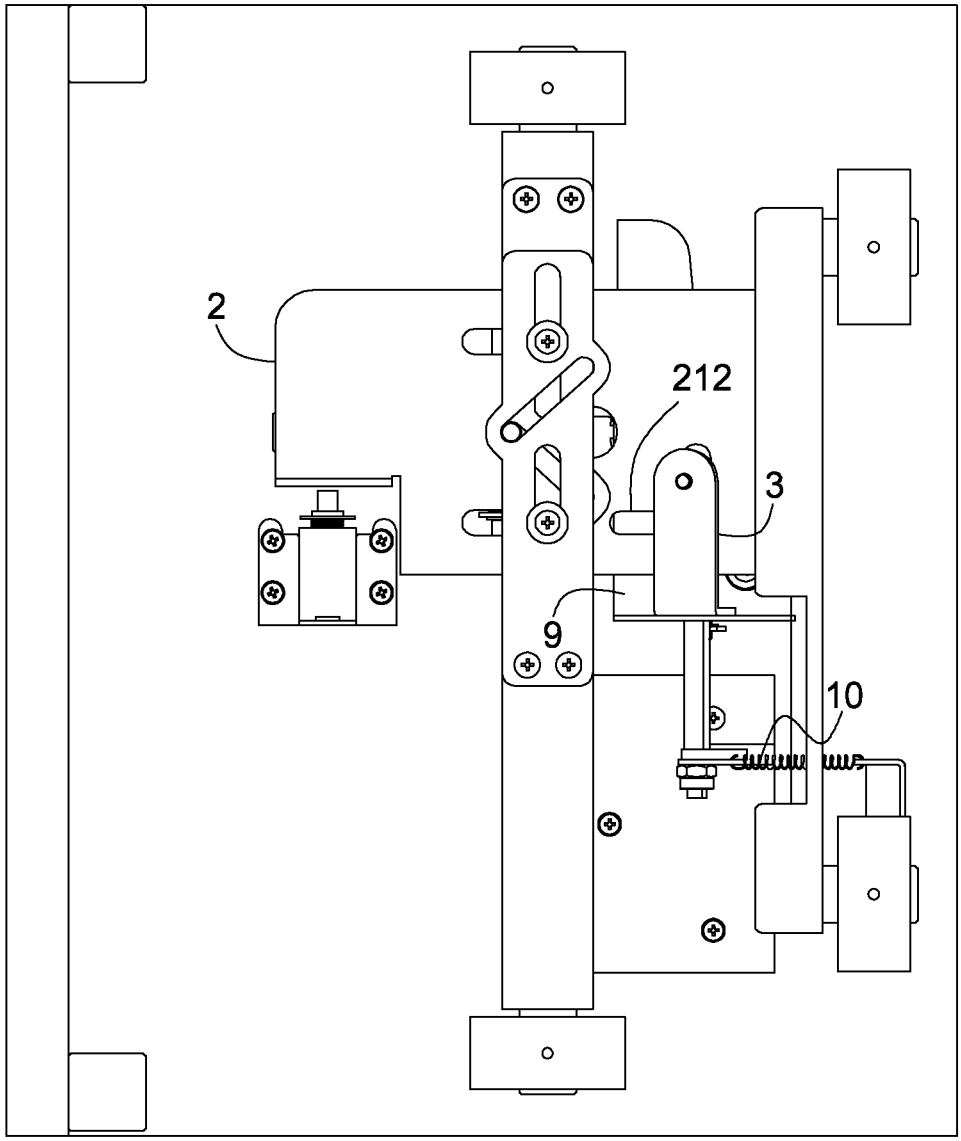
FIG. 7 is yet another flat view thereof.
Figure 8:
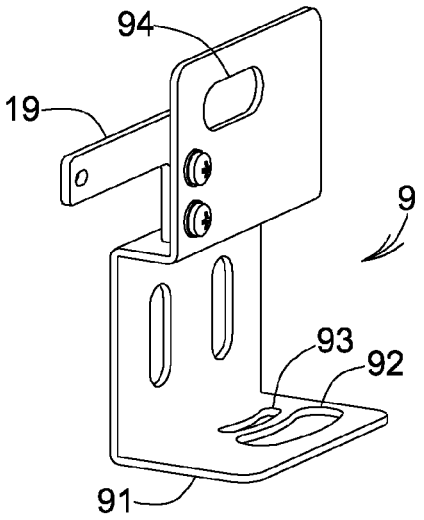
FIG. 8 is a perspective view of an upright toggler thereof.
Figure 9:
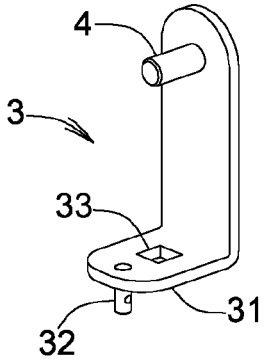
FIG. 9 is a perspective view of a paddle shifter thereof.
Figure 10:
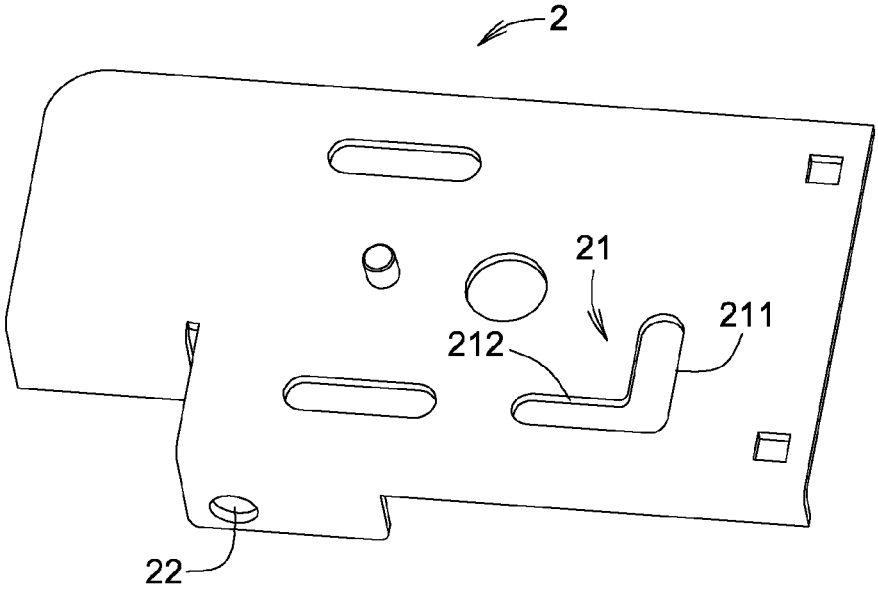
FIG. 10 is a perspective view of a level toggler thereof.
Figure 11:
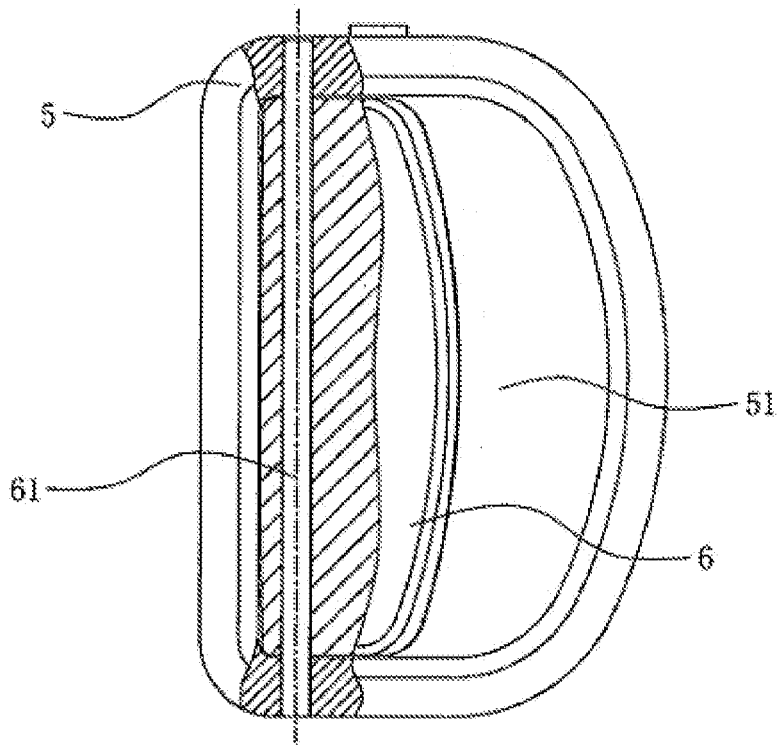
FIG. 11 is partially cross-sectional front flat view of a handle thereof.
Figure 12:
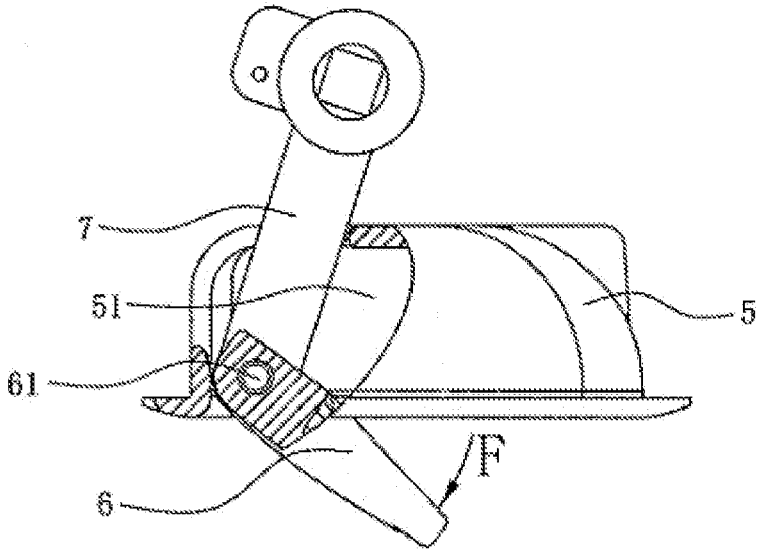
FIG. 12 is partially cross-sectional top flat view of the handle thereof.

Shown in FIGS. 1 through 12 is the preferred embodiment of a door locking system with an idle handle of the invention.

The door locking system has a door panel 1 which has a front face 100, a rear face 101, a hinged side 102, a free side 103, an upper side 104, a lower side 105, and an electronic lock 106 and a mechanical lock 11 installed in the door panel 1 respectively having a keypad and a keyhole on the front face 100.

The door panel 1 further has a level toggler 2 being slidable with respect to the door panel 1 between a hinged side limit and a free side limit and having an L-shaped guiding groove 21 with an upright section 211 and a level section 212, at least one bolt 107 linked to and controlled by the level toggler 2, a chamber 18 defined therein, a handle seat 5 being received and securely fixed in the chamber 18 and having a recess 51 in the front face 100, a handle lever 6 being received in the recess 51 and having a hinged end 62 pivotally linked to the handle seat 5 with a handle pin 61 and a free end 62, a latch lever 12 controlled by the mechanical lock 11 and having a latch finger 13 formed thereon, a linking arm 7 having one end securely fixed to the hinged end 62 and a free linking end, a swivel pillar 8 having a rectangular cross section and a lower end securely fixed to the free linking end of the linking arm 7, a paddle shifter 3 having a top side protrusion 4 slidably received in the guiding groove 21 and a bottom 31 with a rectangular opening 34 slidably covering on the swivel pillar 8, an upright toggler 9 being slidable with respect to the door panel 1 between an upper side limit and a lower side limit and having a bottom plate 91 touching and being fixed to the bottom 31 of the paddle shifter 3 and having an arc-shaped pillar opening 92 covering on the swivel pillar 8, a top opening 94 receiving the latch finger 13, and a side arm 19, and a handle lever resume spring 10 fixed between the linking arm 7 and the door panel 1 pulling the handle lever 6 to press on the recess 51.

In this preferred embodiment, the bottom plate 91 has an arc-shaped fixing opening 93 and the paddle shifter 3 has a bottom pillar 32 extending downward through the arc-shaped fixing opening 93. The bottom plate 91 is fixed to the bottom 31 with a surrounding ring 33 and a pin 34.

There might be a redundant lock provided on the rear face 101 of the door panel 1. The redundant lock has a base 15 formed on the rear face 101 of the door panel 1, a redundant bolt 16 fixed to the side arm 19 and being slidable with respect to the base 15, a redundant spring 17 provided between the base 15 and the redundant bolt 16, and a redundant bolt receiving opening 22 defined in the level toggler 2.

In use, to open the door panel 1, a user is able to first enter a correct pass code of the electronic lock 106 to release an electronic locking to the level toggler 2. Then the user is able to insert and rotate a key to unlock the mechanical lock 11. The latch lever 12, and thus the latch finger 13 formed thereon, will move upward. The upward moving latch finger 13, received in the top opening 94 of the upright toggler 9, will drive the upright toggler 9 to move upward accordingly. The paddle shifter 3 fixed with respect to the upright toggler 9 will be driven to move upward and the side protrusion 4 will move upward to enter the upright section 211 of the L-shaped guiding groove 21. The side arm 19 formed on the upright toggler 9 will also move upward to drive the redundant bolt 16 to move upward to leave the redundant bolt receiving opening 22 of the level toggler 2. At this time, if the user pull the handle lever 6 outward with respect to the handle seat 5 as particularly shown in FIG. 12, the paddle shifter 3, and the side protrusion 4 formed thereon, will levelly move from the free side 103 to the hinged side 102 of the door panel 1 against the handle lever resume spring 10, as particularly shown in FIG. 7. The at least one bolt 107 linked to the level toggler 2 will be drawn to the hinged side 102 of the door panel 1 by the level toggler 2 to unlock the door panel 1. After the door is opened and the user releases the handle lever 6, the paddle shifter 3 will be pulled to levelly move back from the hinged side 102 to the free side 103 under a restoring force from the handle lever resume spring 10. The handle lever 6 will move back into the handle seat 5 and rest on the recess 51, without sticking out from the front face 100 of the door panel 1.

To close and lock the door panel 1, the user is able to anti-rotate the key. The latch lever 12, the upright toggler 2, and the redundant bolt 16 will move downward. The side protrusion 4 enters the level section 212 of the L-shaped guiding groove 21, the redundant bolt 16 enters the redundant bolt opening 22 of the level toggler 2, and the door panel 1 is closed and locked. At this time, if the user pulls the handle lever 6 outward, the side protrusion 4 will levelly move along the level section 212 of the L-shaped guiding groove 21 and will not be able to drive the level toggler 2 to move levelly. The level toggler 2 is further locked by the redundant bolt 16 being received in the redundant bolt opening 22 and will not be able to move levelly.

Figure 13:
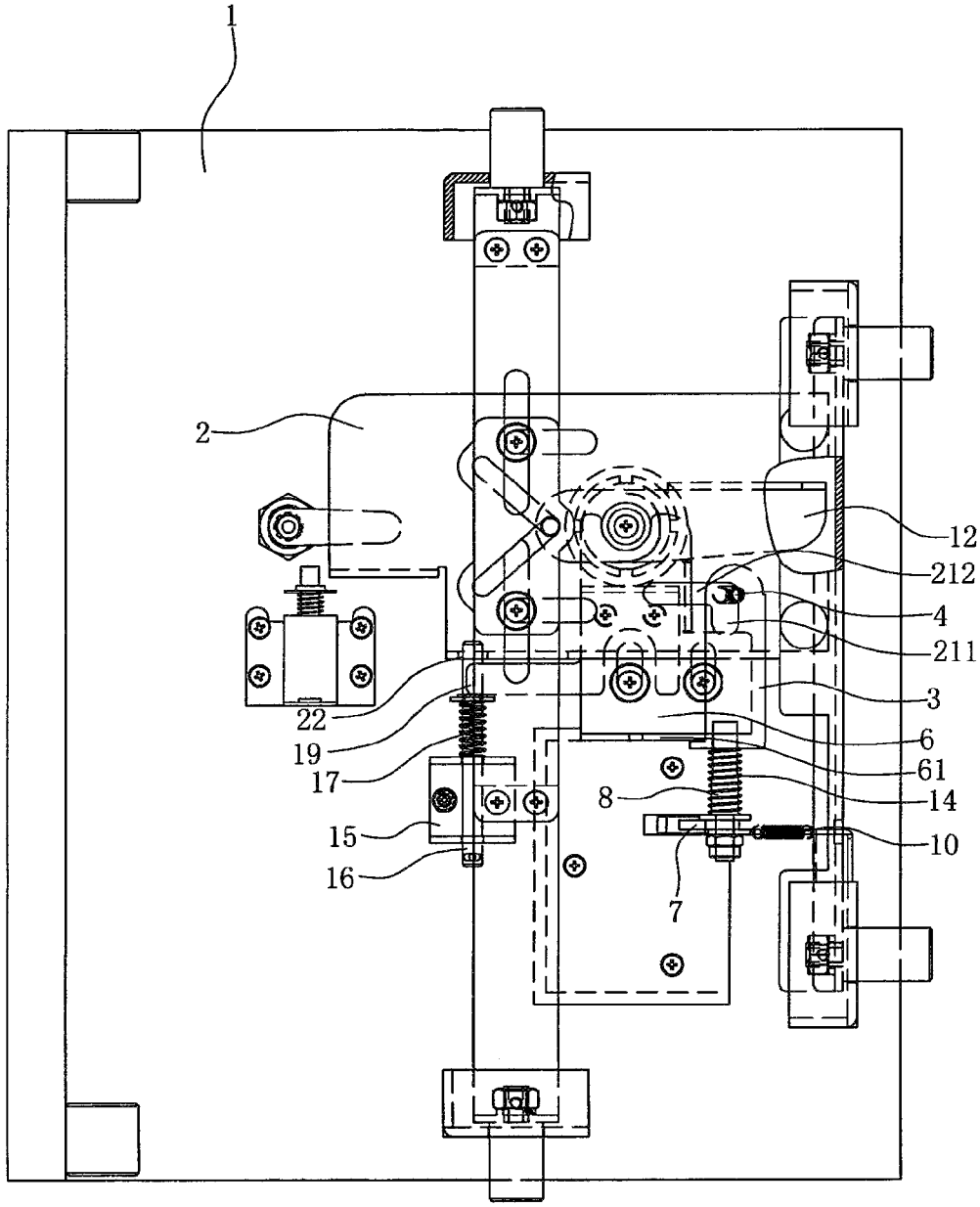
FIG. 13 is a rear flat view of a door panel of another embodiment of the invention.
Figure 14:
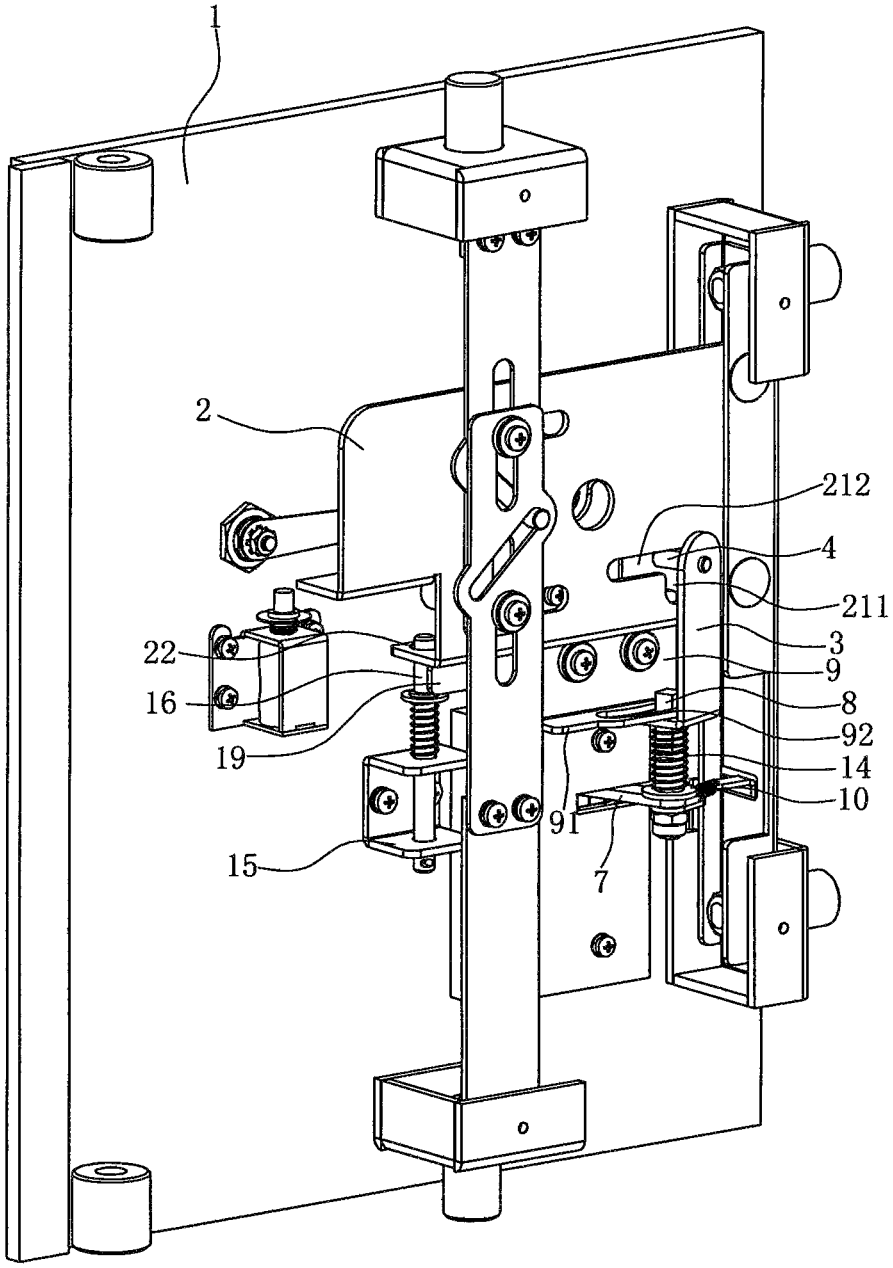
FIG. 14 is a perspective view thereof.
Figure 15:
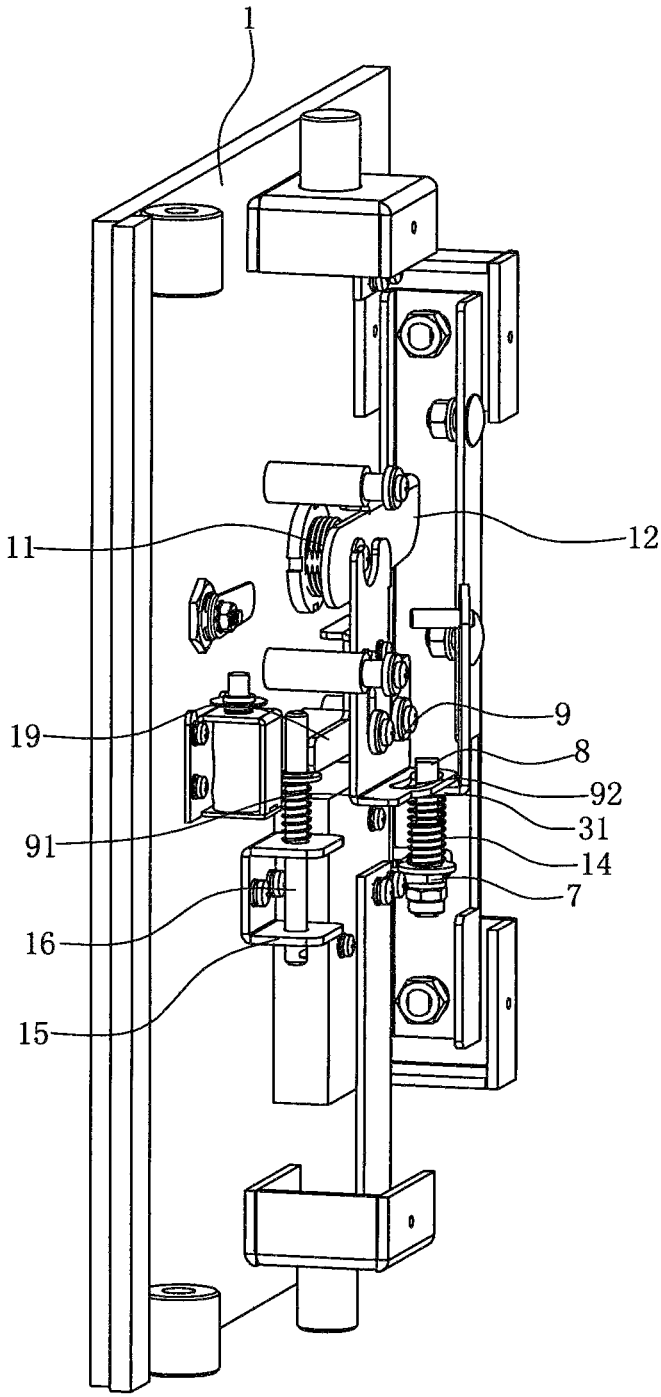
FIG. 15 is another perspective view thereof.
Figure 16:
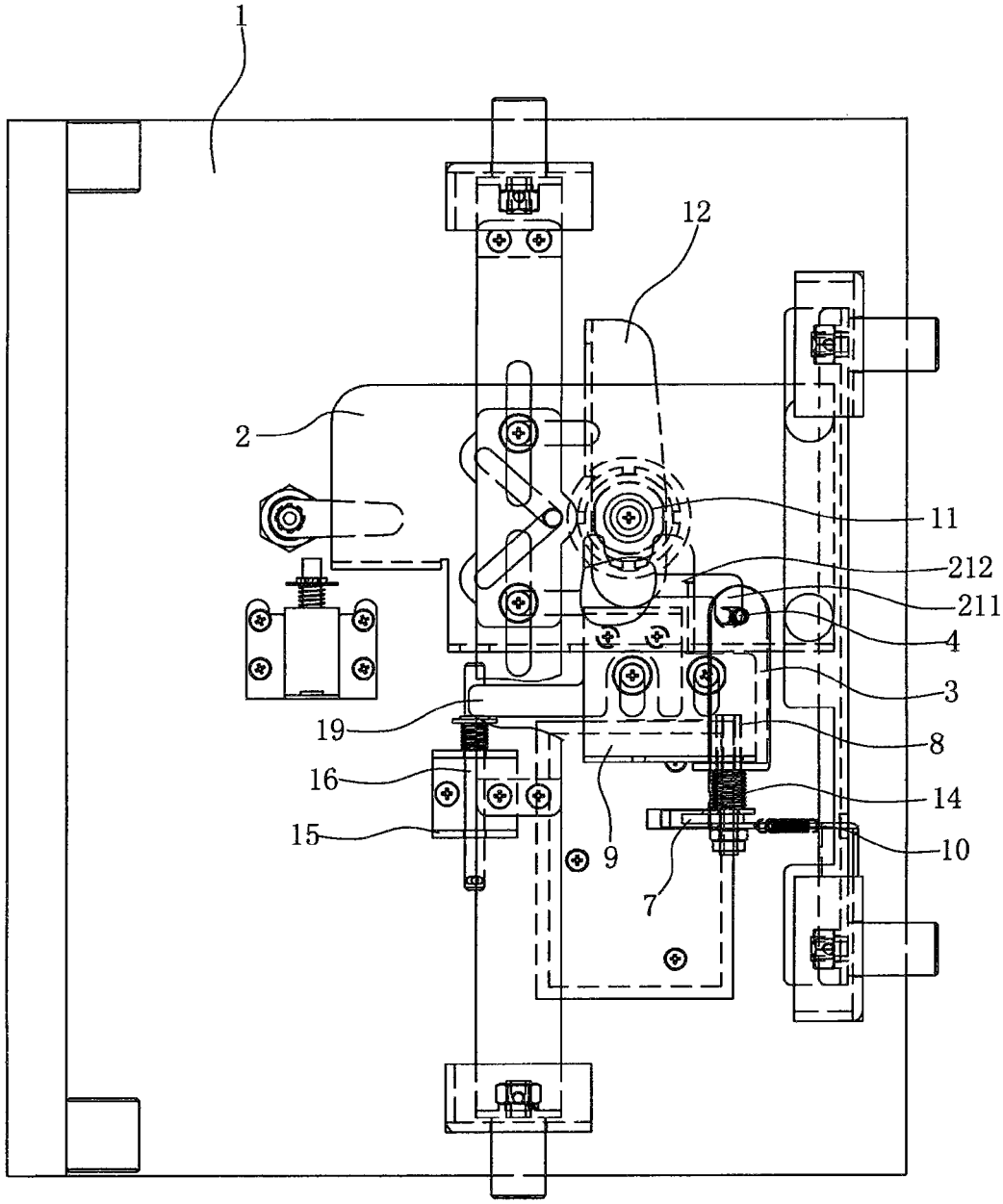
FIG. 16 is yet another rear flat view thereof.
Figure 17:
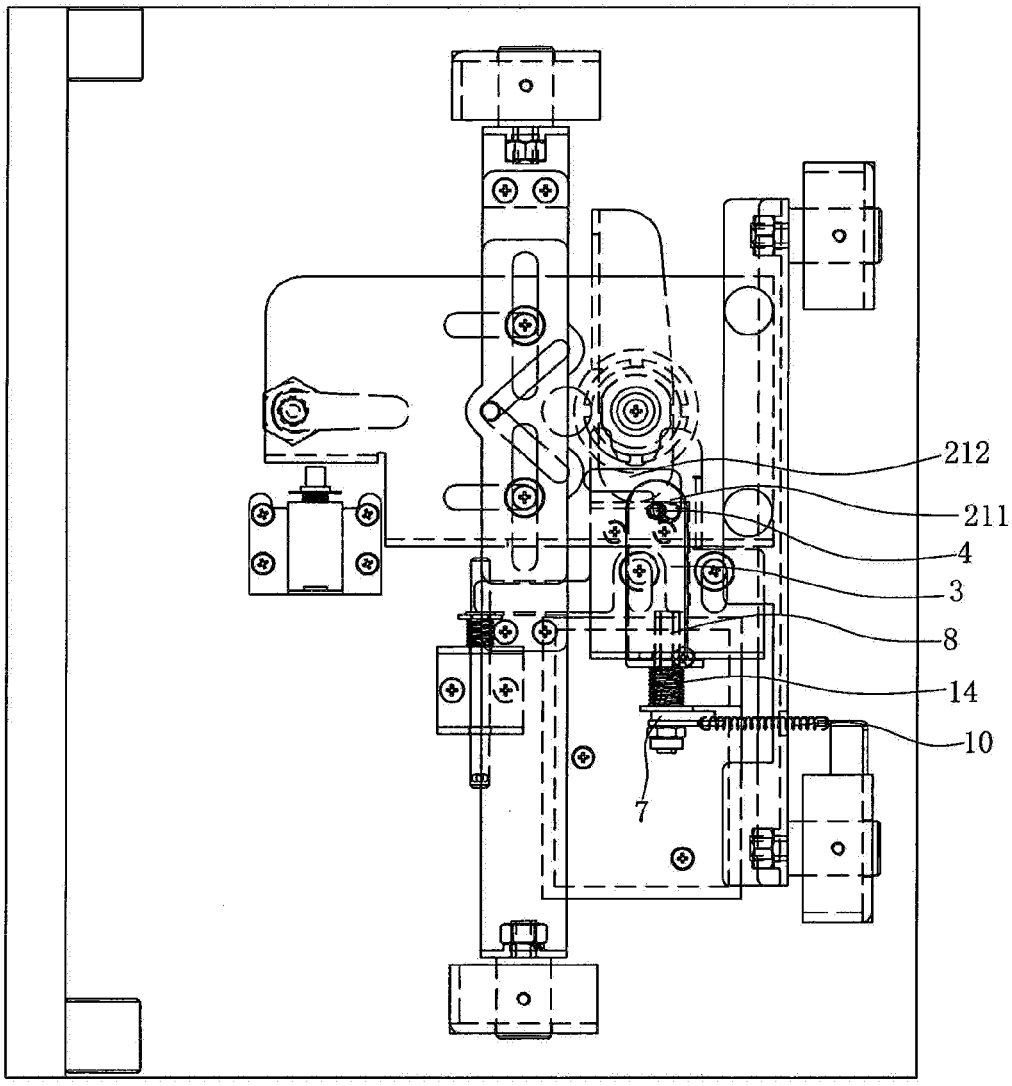
FIG. 17 is still yet another rear flat view thereof.
Figure 18:
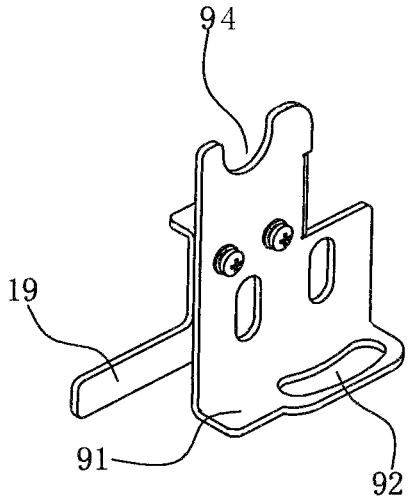
FIG. 18 is a perspective view of an upright toggler thereof.
Figure 19:
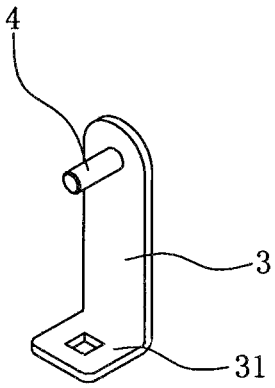
FIG. 19 is a perspective view of a paddle shifter thereof.
Figure 20:
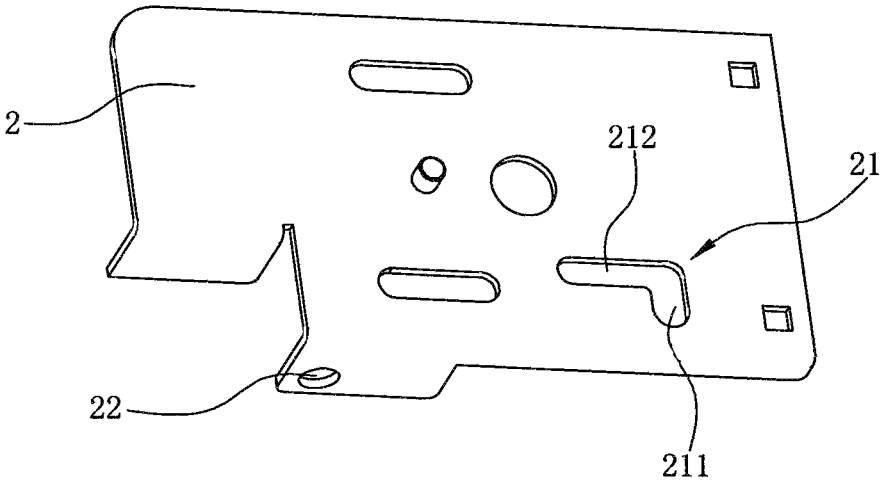
FIG. 20 is a perspective view of a level toggler thereof.

Shown in FIGS. 13 through 20 is another embodiment of the door locking system with an idle handle of the invention. The difference between this and the above embodiment is that the bottom plate 91 is not fixed to the bottom 31 with the surrounding ring 33 and the pin 34 on the bottom pillar 32 passing through the arc-shaped fixing opening 93. The bottom plate 91 is fixed to the bottom 31 with a biasing spring 14 provided between the linking arm 7 and the bottom 31 biasing the bottom 31 to press on the bottom plate 91 of the upright toggler 9. The redundant lock might also be provided for this embodiment.

In use of this embodiment, the user is able to first enter a correct pass code of the electronic lock 106 to release the electronic locking to the level toggler 2. Then the user is able to insert and rotate the key to unlock the mechanical lock 11. The latch lever 12 and the latch finger 13 formed thereon will move downward. The latch finger 13, received in the top opening 94 of the upright toggler 9, will drive the upright toggler 9 to move downward accordingly. The paddle shifter 3 fixed with respect to the upright toggler 9 will be driven to move downward against the biasing spring 14 and the side protrusion 4 will move downward to enter the upright section 211 of the L-shaped guiding groove 21. The side arm 19 formed on the upright toggler 9 will also move downward to drive the redundant bolt 16 to move downward to leave the redundant bolt receiving opening 22 of the level toggler 2. At this time, if the user pull the handle lever 6 outward with respect to the handle seat 5, the door panel 1 will be unlocked and able to be opened. After the door is opened and the user release the handle lever 6, the paddle shifter 3 will be pulled to levelly move back from the hinged side 102 to the free side 103 under the restoring force from the handle lever resume spring 10.

The invention claimed is:

1. A door locking system with an idle handle comprising:

a door panel having a front face, a rear face, a hinged side, a free side, an upper side, a lower side, and an electronic lock and a mechanical lock installed in said door panel respectively having a keypad and a keyhole on said front face, a level toggler being slidable with respect to said door panel between a hinged side limit and a free side limit and having an L-shaped guiding groove with an upright section and a level section, at least one bolt linked to and controlled by said level toggler, a chamber defined in said door panel, a handle seat being received and securely fixed in said chamber and having a recess in said front face, a handle lever being received in said recess and having a hinged end pivotally linked to said handle seat and a free end, a latch lever controlled by said mechanical lock and having a latch finger formed thereon, a linking arm having one end securely fixed to said hinged end and a free linking end, a swivel pillar having a rectangular cross section and a lower end securely fixed to said free linking end of said linking arm, a paddle shifter having a top side protrusion slidably received in said guiding groove and a bottom with a rectangular opening slidably covering on said swivel pillar, an upright toggler being slidable with respect to said door panel between an upper side limit and a lower side limit and having a bottom plate touching and being fixed to said bottom of said paddle shifter and having an arc-shaped pillar opening covering on said swivel pillar, a top opening receiving said latch finger, and a side arm, and, a handle lever resume spring fixed between said linking arm and said door panel pulling said handle lever to press on said recess.

2. The door locking system with an idle handle as claimed in claim 1, wherein said bottom plate further has an arc-shaped fixing opening and said paddle shifter further has a bottom pillar extending through said arc-shaped fixing opening, and said bottom plate is fixed to said bottom with a surrounding ring and a pin.

3. The door locking system with an idle handle as claimed in claim 2, wherein a redundant lock is provided on said rear face of said door panel having a base formed on said rear face of said door panel, a redundant bolt fixed to said side arm and being slidable with respect to said base, a redundant spring provided between said base and said redundant bolt, and a redundant bolt receiving opening defined in said level toggler.

4. The door locking system with an idle handle as claimed in claim 1, wherein said bottom plate is fixed to said bottom with a biasing spring provided between said linking arm and said bottom biasing said bottom to press on said bottom plate of said upright toggler.

5. The door locking system with an idle handle as claimed in claim 4, wherein a redundant lock is provided on said rear face of said door panel having a base formed on said rear face of said door panel, a redundant bolt fixed to said side arm and being slidable with respect to said base, a redundant spring provided between said base and said redundant bolt, and a redundant bolt receiving opening defined in said level toggler.

6. The door locking system with an idle handle as claimed in claim 1, wherein a redundant lock is provided on said rear face of said door panel having a base formed on said rear face of said door panel, a redundant bolt fixed to said side arm and being slidable with respect to said base, a redundant spring provided between said base and said redundant bolt, and a redundant bolt receiving opening defined in said level toggler.

* * * * *